US005970573A

United States Patent [19]

Lahaye

[11] Patent Number: 5,970,573

[45] Date of Patent: Oct. 26, 1999

[54] ENVIRONMENTAL DEVICE FOR CLEANING SURFACES

[76] Inventor: John C. Lahaye, 112 Indian Mound Rd., Lafayette, La. 70501

[21] Appl. No.: 08/810,193

[22] Filed: Mar. 3, 1997

[51] Int. Cl.[6] ..... A47L 11/30

[52] U.S. Cl. ..... 15/321; 15/322; 15/353

[58] Field of Search ..... 15/321, 322

[56] References Cited

U.S. PATENT DOCUMENTS

| | | | |
|---|---|---|---|
| 3,774,260 | 11/1973 | Emus | 15/321 |
| 3,896,521 | 7/1975 | Parise | 15/321 |
| 4,584,736 | 4/1986 | Gremminger | 15/322 |
| 4,720,889 | 1/1988 | Grave | 15/322 |
| 4,872,920 | 10/1989 | Flynn et al. | 15/321 X |
| 5,125,126 | 6/1992 | Bonnant | 15/321 |
| 5,321,869 | 6/1994 | Kaempf | 15/322 |
| 5,561,884 | 10/1996 | Nijland et al. | 15/321 |

*Primary Examiner*—Chris K. Moore

*Attorney, Agent, or Firm*—Domingue & Waddell, PLC

[57] ABSTRACT

The present invention relates to a cost effective and simple apparatus for cleaning surfaces, engines or other machinery parts of environmentally sensitive materials and also containing this material with its cleaning agent for shipment to a permitted recycling facility. Generally the invention comprises a device for cleaning a hazardous material contained on a surface. The device comprises a wash assembly, a vacuum member operatively adapted with said wash assembly, and a delivery member, operatively associated with the wash assembly, for delivering a cleaning agent to the surface. In the preferred embodiment, the wash assembly comprises a hood adapted to engage the surface and a conduit, operatively associated with the hood, for channeling the hazardous material and the cleaning agent into the vacuum member. The vacuum assembly may include a blower member, operatively associated with the conduit, adapted for suctioning the spill and the cleaning agent along with a container associated with the blower member for placing the hazardous material and cleaning agent.

2 Claims, 3 Drawing Sheets

ENVIRONMENTAL DEVICE FOR CLEANING SURFACES

BACKGROUND OF THE INVENTION

1. Field of the Invention

The present invention relates to a device for cleaning surfaces that have been contaminated with hazardous or regulated types of materials. More particularly, but not by way of limitation, this invention relates to a wash and vacuuming device that will clean a surface that has been contaminated with hazardous types of materials, and thereafter, store these hazardous compounds within a safety container for subsequent delivery to a permitted recycling facility.

2. Description of the Prior Art

Discharges of hazardous types of compounds into the environment can cause significant health and safety problems. These types of discharges may ultimately settle on the ground, sea and other surfaces. A major source of pollution is the discharges from automobiles which may leak fuel and/or lubrication oil. Discharges may also occur in fuel spills and accidents.

Generally, the discharges will occur on surfaces such as roads, highways, and parking lots. The amount of hazardous materials contained on these types of surfaces, over a period of time, may become very significant. A particularly harmful effect is the accumulation of the hazardous compounds over a period of time followed by a rain storm. The effect may be to wash some of the hazardous material from the surface; however, the run-off rain water will simply make its way to a stream or drainage system. Obviously, the released hazardous material will cause significant problems to the environment.

Another problem occurs in industrial applications wherein the facility may use hazardous compounds in which to aid in manufacturing. The hazardous materials used by the workers in these facilities will ultimately fall to the surface wherein accumulation may be significant. As is well appreciated by those of ordinary skill in the art, the hazardous materials will require removal. Certainly, the removal of the hazardous materials must be accomplished in a manner that will clean the surface but not allow the transfer of hazardous materials into drains, streams, and gullies. In other words, the cleaning process must not result in transferring the hazardous materials from one site to another site. As a further complicating factor, the cleaning agent employed may also contain hazardous types of compounds that can not be discharged into the environment. Systems presently available may be adequate to clean the surfaces, but also allow runoff to drainage systems not only of the cleaning agent but also the hydrocarbons or other environmentally sensitive material.

Therefore, there is a need for a device that will allow for the removal of hazardous materials from surfaces. There is also a need for an apparatus that will contain the cleaning agent as well as the removed hazardous materials for storage so that the waste may be ultimately disposed in a treatment facility.

SUMMARY OF THE INVENTION

The present invention relates to a cost effective and simple apparatus for cleaning surfaces of environmentally sensitive materials and also containing this material with its cleaning agent for shipment to a permitted recycling facility.

Generally the invention comprises a device for cleaning a hazardous and/or regulated material contained on a surface.

The device comprises a wash assembly, a vacuum member operatively adapted with said wash assembly, and a delivery means, operatively associated with the wash assembly, for delivering a cleaning agent to the surface.

In the preferred embodiment, the wash assembly comprises a hood adapted to engage the surface and conduit means, operatively associated with the hood, for channeling the hazardous material and the cleaning agent into the vacuum member. The vacuum assembly may include a blower member, operatively associated with the conduit means, adapted for suctioning the spill and the cleaning agent along with a container associated with the blower member for placing the hazardous material and cleaning agent.

In the preferred embodiment, the delivery means comprises a tubing associated with the conduit means, with a first end of the conduit means being attached to the hood. The delivery means also contains a control device associated with the second end of the tubing, with the control device adapted to receive the second end of the tubing, the control device adapted to control the amount of cleaning agent discharged to the first end of the tubing. The delivery means may further comprise a nozzle member adapted to be attached to the first end of the tubing and wherein the nozzle member directs the cleaning agent within the hood.

In the preferred embodiment, the hood contains a periphery, and wherein the periphery contains a vinyl member so that the vinyl member contacts the surface to create a vacuum seal. In one embodiment, the hood contains a circular periphery, and wherein the circular periphery contains a vinyl member so that the vinyl member contacts the surface to create a vacuum seal. In another embodiment, the hood contains a rectangular or trapezoidal periphery, and wherein the periphery contains a vinyl member so that the vinyl member contacts the surface to create a vacuum seal.

Also described is an embodiment wherein the container contains a float switch mechanism so that the level of the compounds thus recovered within the container may be monitored. Also included will be a diffuser plate operatively associated with an intake inlet so that the compounds are diffused and properly directed upon entering the container.

An advantage of this invention is that it allows smaller business entities a lower cost means of complying with current regulations by the various Departments of Environmental Quality concerning storm water runoff commingling with hydrocarbon spills. Another advantage is the device herein disclosed would enhance the safety of customers and employees from hazards associated with exposure to hazardous materials.

Another advantage is the portability of the invention coupled with the possible use of regular water as the cleaning agent enables its use by non-technical personnel. The simplicity of operation and low cost would allow a more frequent cleaning schedule. Another advantage is the use of the novel apparatus for cleaning devices; for instance, in cleaning an engine or machinery parts, by placing the disclosed hood over the device and surface. This will allow for the removal of materials contained on the engine or machinery parts and storing of the removed compounds.

DETAILED DESCRIPTION OF THE PREFERRED EMBODIMENTS

Figure 1:
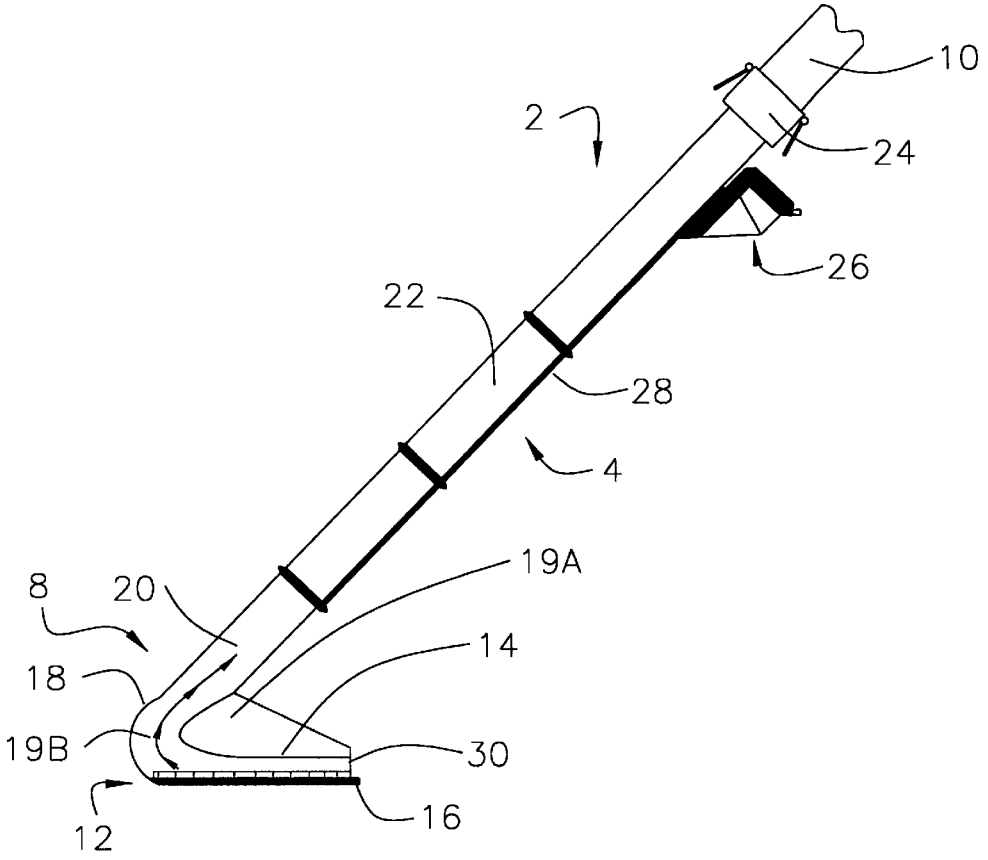
FIG. 1 is a perspective side view of the wash assembly and delivery means of the present invention.

Referring now to FIG. 1, a perspective side view of the wash assembly 2 and delivery means 4 of the present invention are depicted. Generally, the invention comprises a wash assembly 2, a vacuum assembly 6 (seen in FIG. 3), a suction enclosure 8, a standard two inch flexible vacuum hose 10, and delivery means 4 for providing a high pressure and high temperature cleaning agent to the wash assembly 2.

Thus, the wash assembly of FIG. 1 includes the suction enclosure 8 that generally contains a rectangular or trapezoidal base portion 12 having four sides. The base portion 12 will contain an outer periphery that has contained thereon a skid member 14 that is associated with a seal member 16. The vinyl seal 16 is placed on the perimeter lower relative to the skid 14 so that the seal member 16 will contact the surface. In this manner, the vinyl seal 16 will cooperate with the surface to be cleaned, as more fully set out later in the application. In the preferred embodiment, the skid member 14 is constructed of a Teflon compound and the seal member 16 is constructed of a vinyl compound.

Figure 2:
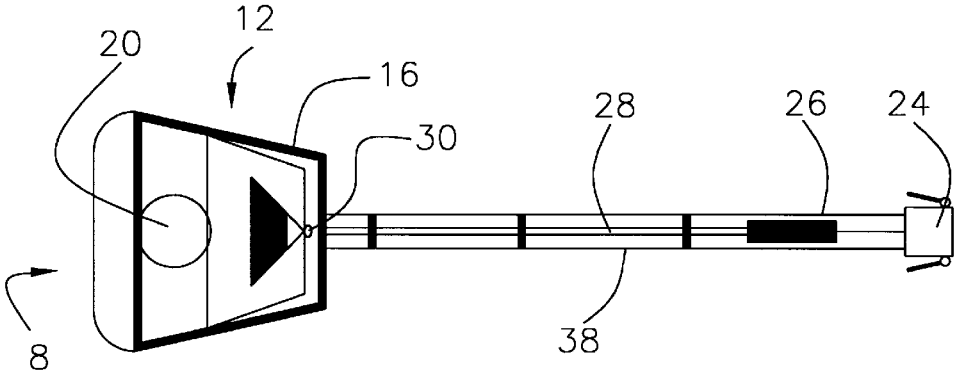
FIG. 2 is a perspective bottom view of the wash assembly and delivery means of the present invention.

The base portion 12 will extend to an enclosed hood 18, with the enclosed hood 18 containing the opening 20. The vacuum flow is steered via the diverter insert 19A. Thus, the vacuum flow is channeled from the nozzle 30 to passageway 19B so that a partial vertical flow is created. As shown in FIGS. 1 and 2 by the arrows, the direction of flow is from aft of the nozzle 30 to the passageway 19B which is caused by the direction of discharge from the nozzle as well as the inclination of the passageway 19B vis-a-vis the diverter insert 19A.

As part of the wash assembly 2, a conduit 22 extends from the opening 20, with the conduit 22 terminating at the sealable hose fitting device 24. The hose fitting device 24 will have extending therefrom a flexible hose member 10 that will be attached to the vacuum assembly 6, as will be fully explained with reference to FIG. 3.

Returning again to FIG. 1, the delivery means 4 for delivering a cleaning agent to the surface to be cleaned will now be described. The delivery means 4 includes the flow control member 26 which is a valve type member that allows the operator to open or close the valve by manual operation. Further, the flow control member 26 may be variable opening so that less than total quantity of the treating cleaning agent may be released. The delivery means 4 also includes the tubing 28 that continues from the flow control member 26, with the tubing 28 extending to the inner portion of the hood 18. The tubing 28 will be operatively connected to the nozzle 30 that is used to inject the cleaning agent at a high volume such as 2000 psi and high temperature such as 190 degrees Fahrenheit at a rate of 2 gallons per minute. As noted in FIG. 1, the nozzle 30 will be disposed such that the cleaning agent is directed at an angle that will intersect the surface to be cleaned while also directing the stream to passageway 19B. Depending on the texture of the surface, and the type of hazardous material, the angle may be varied for optimum recovery. However, the angle is such that the cleaning agent is generally directed towards the center of the enclosed area so that the hazardous material may be more easily suctioned into the vortex of passageway 19B. In one embodiment, the spray nozzle 18 is configured to direct the spray to an area forward of the nozzle 18 at 45 degrees and extending to either side of the nozzle 18 approximately 75% of the width within the hood 12.

Referring now to FIG. 2, a perspective bottom view of the wash assembly 2 and delivery means 4 of the present invention is shown. It should be noted that like numbers appearing in the various figures represent like components. Thus, FIG. 2 illustrates the amount of area that will be under the hood enclosure 8 and subjected to the suctioning of the vacuum assembly. Further, FIG. 2 shows the nozzle 30 along with the spray pattern produced. Other types of spray patterns are possible. FIG. 2 also shows the tubing 28 that leads from the nozzle 30, with the tubing being connected to the flow control member 26. The flow control member 26 will be connected to a cleaning agent reservoir (not shown). The cleaning agent may be soap, solvent, de-greaser, etc. The cleaning agent may also be water. In fact, the delivery of a high-pressure and high-temperature water solution is the most effective cleaning solution in some circumstances.

Figure 3:
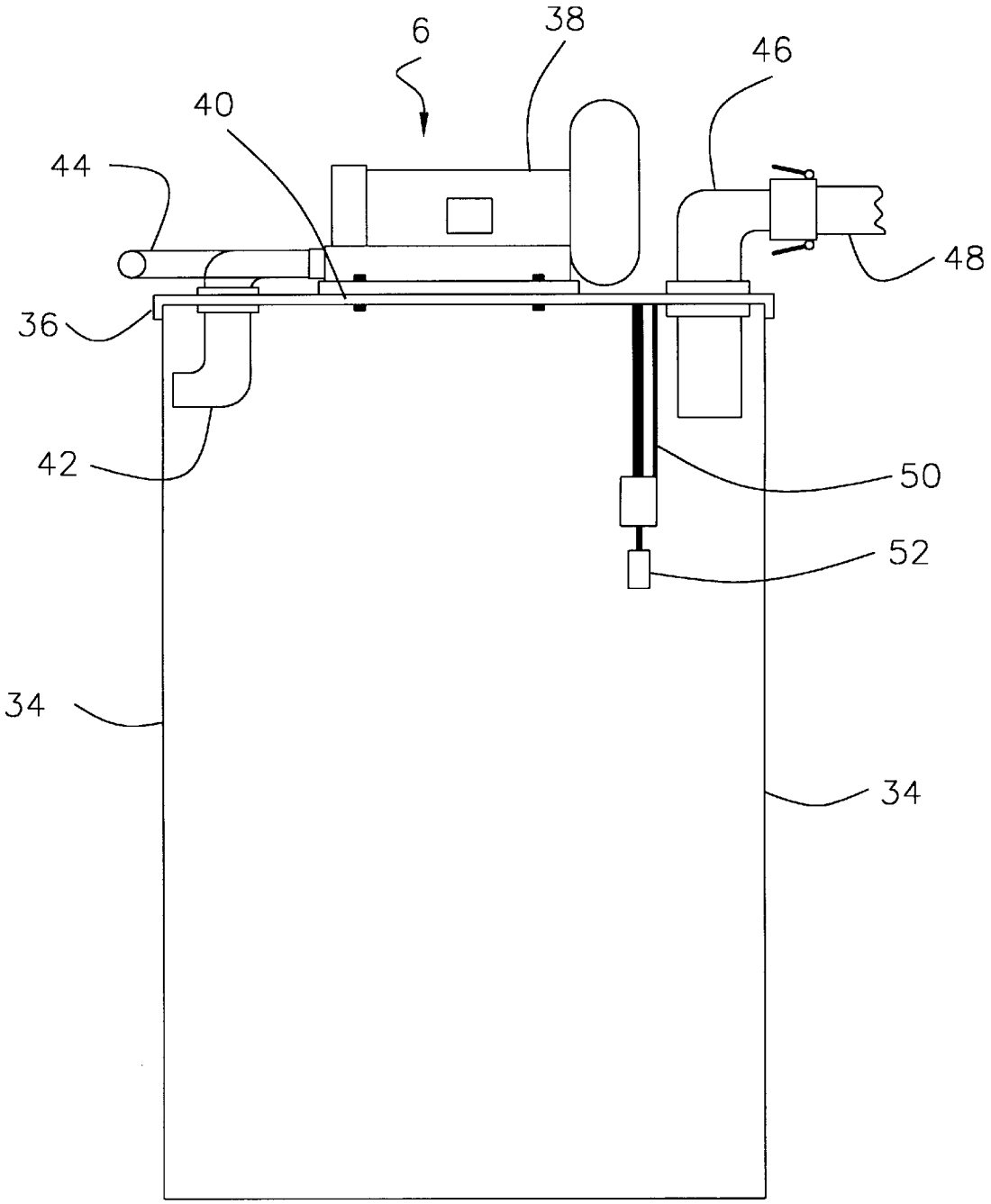
FIG. 3 is a perspective side view of the container with the vacuum assembly.

Referring now to FIG. 3, the environmentally sensitive material with the cleaning agent is vacuumed into a container 34 which in the preferred embodiment is a standard 55 gallon UN approved steel open top drum. The vacuuming effect is achieved by a vacuum assembly 6, shown in FIG. 3, and includes a sealable drum lid 36 on which the vacuum assembly 6 is mounted. The vacuum assembly 6 can be replaced by a standard drum lid when the respective container 34 is filled.

Components of the vacuum assembly 6 are a regenerative blower 38 (or other type of vacuum source) mounted on a sealable drum lid 36 by bolts with vibration isolators 40, having an intake 42 below the drum lid 36 and an exhaust 44 to the atmosphere; a vacuum inlet 46 with a sealable hose fitting 48 above drum lid 36; a direction plate 50 below drum lid 36 for directing the spray from vacuum inlet 46 as well as directing the incoming mist away from the blower intake 42. The vacuum assembly also includes a normally closed explosion proof float switch 52 for deactivating the regenerative blower 44 when container 34 is filled.

Figure 4:
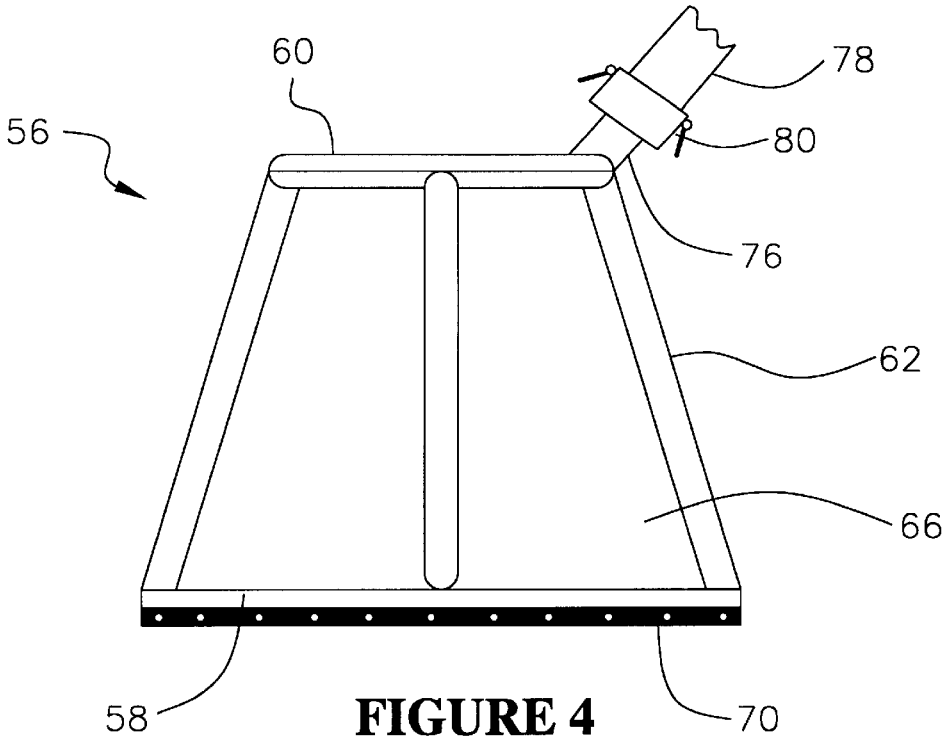
FIG. 4 is a perspective side view of a second embodiment of the suction enclosure.

Another embodiment may be utilized according to the teachings of the present invention. In FIG. 4, a perspective side view of a second embodiment of the suction enclosure and in FIG. 5, a perspective bottom view of the suction enclosure of FIG. 4 are illustrated. One use of these embodiments include when the environmentally sensitive material is in a particle form and/or a cleaning agent is not required, a suction enclosure 56, shown in FIGS. 4 and 5, can be used instead of the suction enclosure 8 with vacuum assembly 6. The embodiment of FIGS. 4 and 5 include a lower circular ring 58 that extends to an upper circular ring 60 of smaller diameter. The sides of this conically shaped enclosure contain vertical struts 62 forming the skeletal structure of suction enclosure 56. These circular rings 58 and 60 with vertical struts 62 are made of two inch aluminum tubing. The vertical struts 62 are so attached to circular rings 58 and 60 that vacuumed material can be carried from circular ring 58 to circular ring 60 through vertical struts 62.

Figure 5:
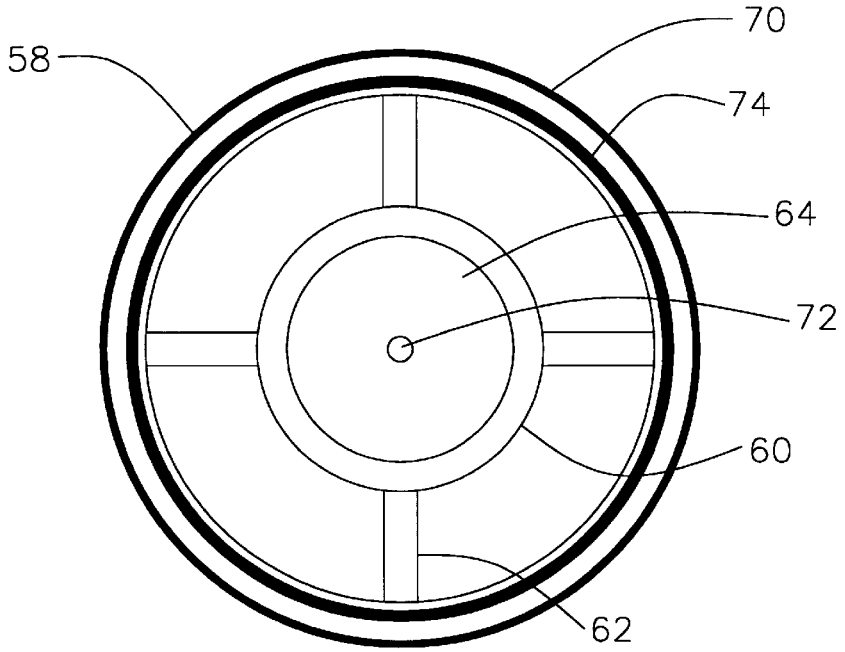
FIG. 5 is perspective bottom view of the suction enclosure of FIG. 4.

As shown in FIG. 5, the suction enclosure 56 has a circular plexiglass plate 64 attached on the inside circumference of circular ring 58 and other plexiglass sheets 66 attached between adjacent vertical struts 62 and circular rings 58 and 60. A seal member 70, which consist of a vinyl compound, is attached to the outside lower circumference of circular ring 58 for directing the vacuuming to the inside of suction enclosure 56 as well as providing a seal with the surface. The two inch diameter circular opening 72 at the center of plexiglass plate 64 allows sufficient air to carry the vacuumed material through a quarter inch circular opening 74 on the lower inside circumference of circular ring 58.

To carry the vacuumed material out of suction enclosure 56, a two inch aluminum tubing 76 is attached to circular ring 60 at an angle of approximately 45 degrees. The upper end of aluminum tubing 76 has a vacuum hose fitting 58 attached. The operator may desired to simply insert a high pressure delivery means, such as a hose with a nozzle, through the opening 72. The suctioning may continue while the treatment with the delivery means is in progress.

A standard two inch flexible vacuum hose 78 of desired length is used to connect the vacuum assembly 6 at hose fitting 80 to either the wash assembly 2 at hose fitting 48 or the suction enclosure 56 at hose fitting 80. A cleaning agent at the required pressure and temperature may be furnished to the flow control 26 by a standard steam cleaner.

Changes and modifications in the specifically described embodiments can be carried out without departing from the scope of the invention which is intended to be limited only by the scope of the appended claims.

What is claimed is:

1. A device for cleaning a hazardous material with a cleaning agent contained on a surface, the device comprising:

a wash assembly comprising: a hood adapted to engage the surface and wherein said hood contains a periphery having a vinyl member that contacts the surface to create a vacuum seal;

a vacuum member connected to said wash assembly by a vacuum, said vacuum member comprising: a container; a sealable container lid for mounting a regenerative blower having an intake within said container through said sealable container lid for producing a vacuum within said container; a vacuum inlet through said sealable container lid for suction of the hazardous material and the cleaning agent into said container; a sealable hose fitting on an outside end of said vacuum inlet for connecting an end of said vacuum hose; a float switch mounted on an under side of said sealable container lid and within said container for deactivating said regenerative blower upon filling of said container with the hazardous material and the cleaning agent;

a delivery means, operatively associated with said wash assembly, for delivering the cleaning agent to the surface, said delivery means comprising: a tubing having a first end and a second end, with the first end being attached to said hood;

a flow control device associated with said second end of said tubing, with said flow control device adapted to receive said second end of said tubing, said flow control device adapted to control the amount of the cleaning agent discharged from said first end of said tubing.

2. The device of claim 1 wherein said container comprises:

a director plate operatively associated with said intake inlet so that said spill is diffused upon entering said container:

and wherein said hood further comprises:

a diverter insert located in said hood, for steering the cleaning agent trough said hood.

* * * * *